US006382686B1

(12) United States Patent
Ishigaki et al.

(10) Patent No.: US 6,382,686 B1
(45) Date of Patent: May 7, 2002

(54) CHILD-PROOF MECHANISM FOR VEHICLE DOOR LATCH DEVICE

(75) Inventors: Hiroshi Ishigaki; Jiro Inoue; Kazuhito Yokomori, all of Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/612,276

(22) Filed: Jul. 7, 2000

(30) Foreign Application Priority Data

Jul. 7, 1999 (JP) ..... 11-192915
Jul. 7, 1999 (JP) ..... 11-192916

(51) Int. Cl.[7] ..... E05C 3/06
(52) U.S. Cl. ..... 292/201; 292/DIG. 23
(58) Field of Search ..... 292/216, 201, 292/DIG. 23, DIG. 43, DIG. 42

(56) References Cited

U.S. PATENT DOCUMENTS 4,492,395 A * 1/1985 Yamada ..... 292/216
4,969,673 A * 11/1990 Portelli et al. ..... 292/216
5,052,731 A * 10/1991 Hayakawa et al. ..... 292/336.3
5,476,294 A * 12/1995 Menke ..... 292/216
5,494,322 A * 2/1996 Menke ..... 292/216
5,520,425 A 5/1996 Dowling
5,618,068 A 4/1997 Mitsui et al.
5,921,612 A * 7/1999 Mizuki et al. ..... 296/155
6,102,453 A * 8/2000 Cetnar ..... 292/201
6,135,513 A * 10/2000 Hamada et al. ..... 292/201
6,168,215 B1 * 1/2001 Kodama et al. ..... 292/201
6,198,242 B1 * 3/2001 Yokomori et al. ..... 318/445

* cited by examiner

*Primary Examiner*—Brian L. Johnson
*Assistant Examiner*—Bryan Fischmann
(74) *Attorney, Agent, or Firm*—Browdy and Neimark

(57) ABSTRACT

A vehicle door latch device has a child-proof mechanism provided between an inner lever and an open lever, a powered closing mechanism arranged to rotate a latch toward a full-latched position from a half-latched position by motor power, and a safety mechanism arranged to urgently stop actuation of the powered closing mechanism in response to rotation of the open lever. The child-proof mechanism has a transmitting device which transmits the rotation of the inner lever to the safety mechanism to actuate the safety mechanism, without rotating the open lever in the child-proof state.

5 Claims, 6 Drawing Sheets

Fig. 9
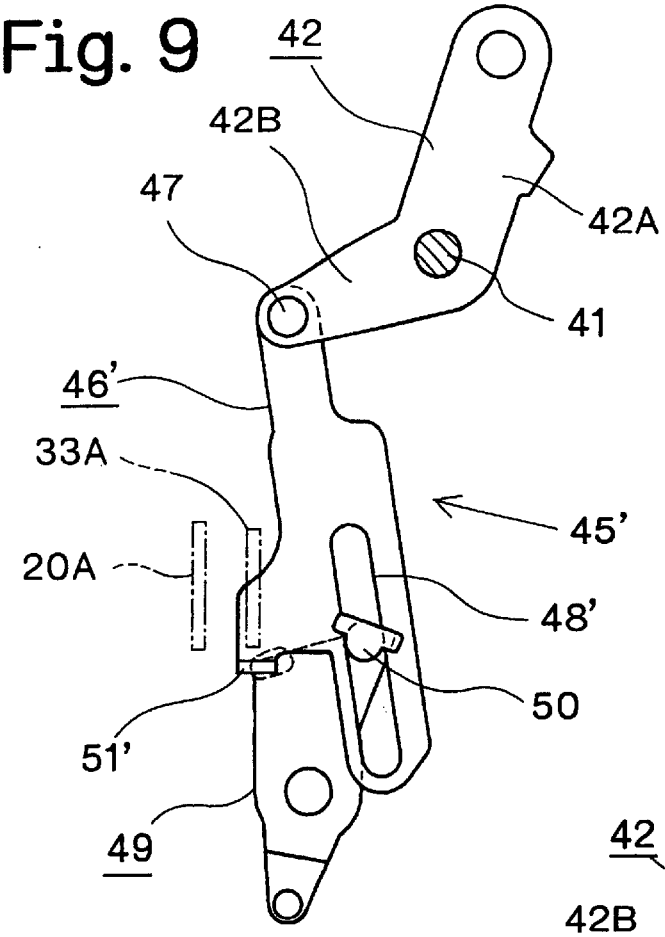
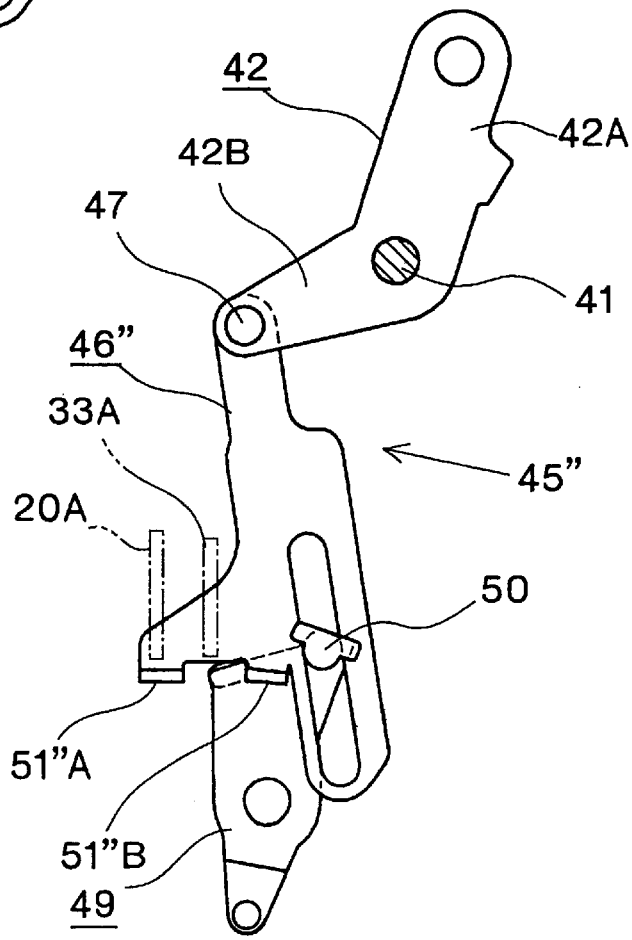
Fig. 10

CHILD-PROOF MECHANISM FOR VEHICLE DOOR LATCH DEVICE

BACKGROUND OF THE INVENTION

1. Field of the Invention

The present invention relates to a child-proof mechanism for a vehicle door latch device.

2. Prior Art

A prior art vehicle door latch device has a striker fixed to a vehicle body, a latch engageable with the striker, a ratchet engageable with the latch to keep the engagement between the latch and the striker, and an open lever connected to outside and inside open handles of a vehicle door to release the ratchet from the latch by opening actuation of the open handles.

Furthermore, the door latch device for rear doors mostly has a child-proof mechanism provided between the open lever and the inside open handle of the door. The child-proof mechanism is displaceable between a non-child-proof state of transmitting the opening actuation of the inside open handle to the open lever and a child-proof state of transmitting no opening actuation of the inside open handle to the open lever.

Furthermore, U.S. Pat. No. 5,520,425 and U.S. Pat. No. 5,618,068 disclose a powered closing mechanism which displaces the door to a full-closed position from an initially-closed position by moving the latch to a full-latched position from a half-latched position by using a motor power. The powered closing mechanism has a safety mechanism which is actuated in response to the rotation of the open lever. The safety mechanism urgently stops the actuation of the powered closing mechanism when the open lever is rotated by the opening actuation of the outside or inside open handle.

The prior art child-proof mechanism is uncongenial with the safety mechanism of the powered closing mechanism. That is, when the child-proof mechanism is in the child-proof state, the opening actuation of the inside open handle is not transmitted to the open lever, and therefore, it becomes impossible to actuate the safety mechanism by the opening actuation of the inside open handle.

SUMMARY OF THE INVENTION

Accordingly, it is an object of the present invention to provide an improved child-proof mechanism which is congenial with a safety mechanism of a powered closing mechanism.

BRIEF DESCRIPTION OF THE DRAWINGS

FIG. 9 is a side view showing the child-proof mechanism of the second embodiment in the child-proof state; and FIG. 10 is a rear view showing a child-proof mechanism of a third embodiment according to the present invention.

PREFERRED EMBODIMENTS OF THE INVENTION

Figure 1:
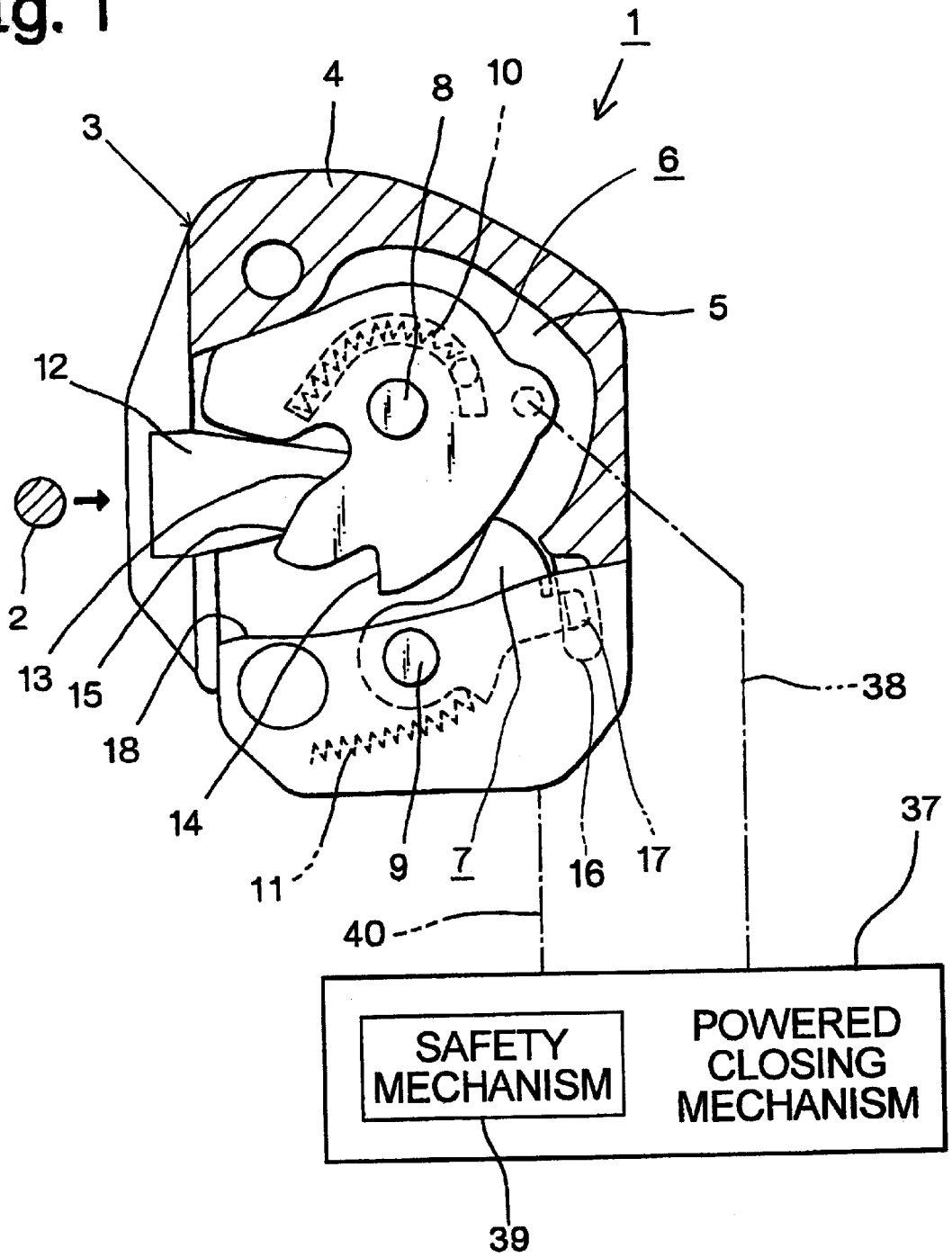
FIG. 1 is a front view of a latch unit according to the present invention.

Preferred embodiments of a vehicle door latch device according to the present invention will be described by referring to the accompanying drawings. The vehicle door latch device 1 has a striker 2 fixed to a vehicle body (not shown) and a latch unit 3 attached to a door for a vehicle rear seat (not shown).

The latch unit 3 has a latch 6 which is engaged with the striker 2 when the door is closed, and a ratchet 7 which keeps engagement between the latch 6 and the striker 2. The latch 6 is rotatably contained in a recess 5 formed in the front surface of a synthetic resin latch body 4 by a latch shaft 8, and the ratchet 7 is rotatably contained in the recess 5 by a ratchet shaft 9. The latch 6 is urged in the clockwise direction in FIG. 1 by the elasticity of a latch spring 10, and further, the ratchet 7 is urged in the counterclockwise direction by the elasticity of a ratchet spring 11.

When the door is open, as shown in FIG. 1, the latch 6 is kept in an unlatched position or open position by the elasticity of the latch spring 10. When the door is moved toward a closed position, the striker 2 enters a horizontal passage 12 formed in the latch body 4 to come into contact with a U-shaped groove 13 of the latch 6, thereby the latch 6 is turned counterclockwise against the elasticity of the latch spring 10. When the latch 6 is rotated up to a half-latched position, the ratchet 7 is engaged with a first step 14 of the latch 6 and the door is shifted to a half-closed state. Furthermore, when the latch 6 reaches a full-latched position, the ratchet 7 is engaged with a second step 15 of the latch 6 and the door is kept in a full-closed state.

Figure 2:
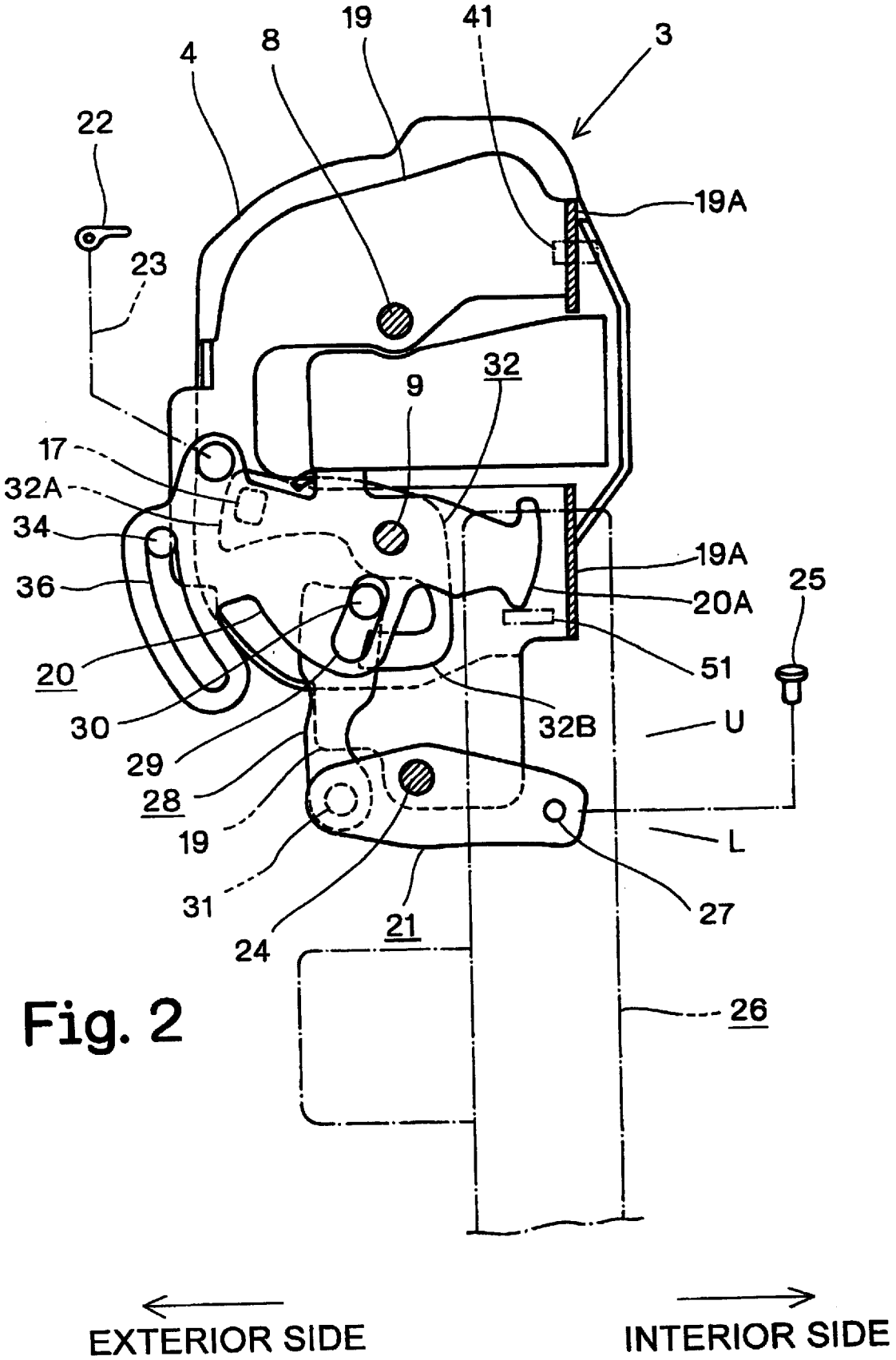
FIG. 2 is a rear view of the latch unit.
Figure 3:
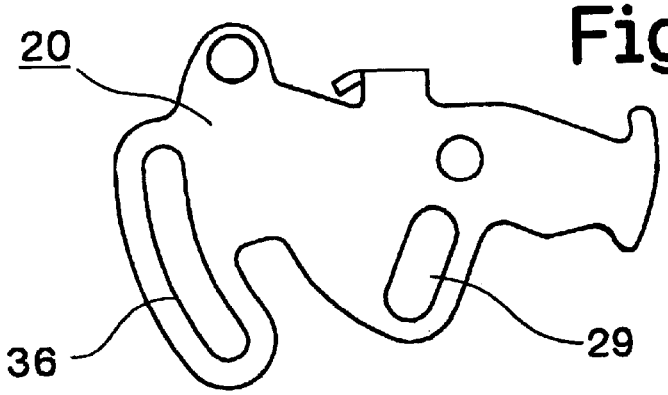
FIG. 3 is a rear view of an open lever of the latch unit.

The ratchet 7 has a ratchet pin 17 which projects to a rear side of the latch body 4 through an opening 16 of the latch body 4. A metal cover plate 18 for substantially shutting the recess 5 is fixed to the front surface of the latch body 4. The cover plate 18 is partially indicated in FIG. 1. To the rear side of the latch body 4, as shown in FIG. 2, a metal back plate 19 is fixed. The back plate 19 is formed integrally with a bent plate 19A which is angled to extend backward from an interior side portion of the back plate 19.

As shown in FIG. 2, the latch unit 3 has an open lever 20 for opening the door by releasing the ratchet 7 from the latch 6, and a lock lever 21 for changing over the latch unit 3 between a locked state and an unlocked state. The open lever 20 is rotatably attached on the rear side of the latch body 4 by the ratchet shaft 9. An exterior side end of the open lever 20 is connected to an outside open handle 22 of the door with a lost motion (not shown) through a rod 23. The lock lever 21 is rotatably attached to the latch body 4 or the back plate 19 by a lock shaft 24. An interior side end of the lock lever 21 is connected to an inside lock button 25 of the door.

To the bent plate 19A, a motorized actuator 26 is fixed, if desired. An output lever (not shown) of the actuator 26 is engaged with a connection hole 27 formed in the interior side end of the lock lever 21, so that the lock lever 21 can be displaced between an unlocked position U and a locked position L by the actuation of the actuator 26.

Between the lock lever 21 and the open lever 20, a lock link 28 is provided. The lock link 28 has a lock pin 30 which is slidably engaged with an elongated hole 29 formed in the open lever 20. The lock link 28 is connected to the lock lever 21 by a shaft 31.

To the ratchet shaft 9, a ratchet lever 32 is pivotally supported. The ratchet lever 32 is provided between the latch body 4 and the open lever 20. An outer arm 32A of the ratchet lever 32 extending to the exterior side is engaged with the ratchet pin 17 extending backward from the ratchet 7, so that the ratchet lever 32 can be rotated integrally with the ratchet 7.

The lock lever 21 is switched between the unlocked position U and the locked position L by the actuation of the lock button 25 or the actuator 26, as is well known. When the lock lever 21 is rotated counterclockwise from the position in FIG. 2 to be displaced to the unlocked position U, the lock pin 30 is moved downward within the elongated hole 29 to be engageably opposed to a contact arm 32B of the ratchet lever 32. In this unlocked state, when the open lever 20 is rotated counterclockwise by the opening actuation of the outside open handle 22, the lock pin 30 is brought into contact with the contact arm 32B to rotate the ratchet lever 32 counterclockwise. Thereby, the latch 6 is released from the ratchet 7, and the door is then opened.

On the contrary, when the lock lever 21 exists in the locked position L in FIG. 2, the engageable state between the lock pin 30 and the contact arm 32B is released. Therefore, in the locked state, even if the open lever 20 is rotated counterclockwise by the outside open handle 22, the ratchet lever 32 is not rotated, so that the door cannot be opened.

Figure 4:
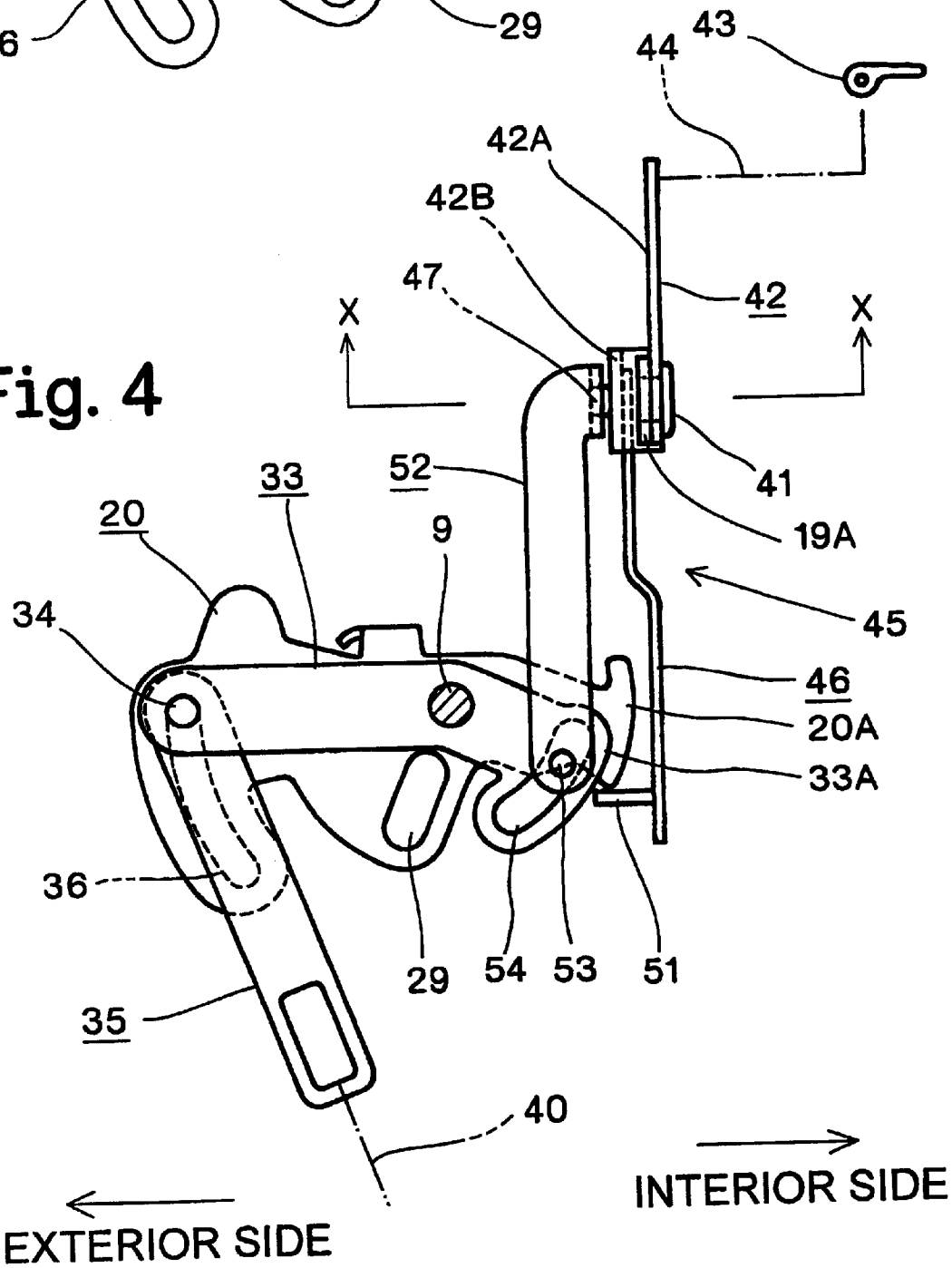
FIG. 4 is a rear view showing a child-proof mechanism of the latch unit.

To the ratchet shaft 9, as shown in FIG. 4, a safety lever 33 overlapped with the open lever 20 is rotatably attached. The safety lever 33 is omitted in FIG. 2. An upper end of a wire link 35 is connected to the exterior side end of the safety lever 33 by a connection pin 34 which is slidably engaged with a circular arc slot 36 formed in the exterior side end of the open lever 20. When the open lever 20 is rotated by the opening actuation of the outside open handle 22, the safety lever 33 is pressed by the connection pin 34 so as to be rotated. However, even when the safety lever 33 is rotated, the open lever 20 is not rotated because of the lost motion defined between the slot 36 and the pin 34.

As shown in FIG. 1, the latch device 1 has a powered closing mechanism 37 which moves the door to the full-latched state from the half-latched state. The motor power of the closing mechanism 37 is transmitted to the latch 6 of the latch unit 3 through a flexible power wire 38. When the door is moved to the half-latched state from the open state by the manual power, the closing mechanism 37 is actuated to rotate the latch 6 toward the full-latched position from the half-latched position through the power wire 38.

The powered closing mechanism 37 has a safety mechanism 39. The safety mechanism 39 is connected to the wire link 35 through a flexible safety wire 40 and, if necessary, a clank lever (not shown). The safety mechanism 39 is actuated, in response to the rotation of the safety lever 33, to stop a motor of the closing mechanism 37, and at the same time, it releases the power wire 38. Accordingly, in order to stop the actuation of the closing mechanism 37 urgently, the safety lever 33 should be rotated through the open lever 20 by the opening actuation of the outside open handle 22.

To the bent plate 19A, an L-shaped inner lever 42 is pivotally supported by a shaft 41. A first arm 42A of the inner lever 42 is connected to an inside open handle 43 of the door through a wire or rod 44.

Figure 5:
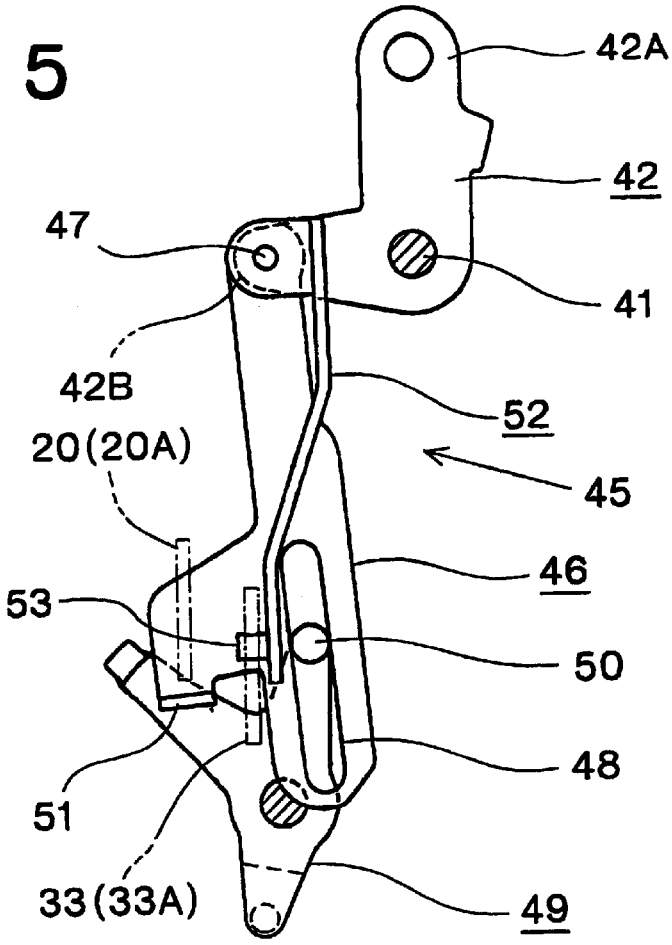
FIG. 5 is a side view showing the child-proof mechanism.
Figure 6:
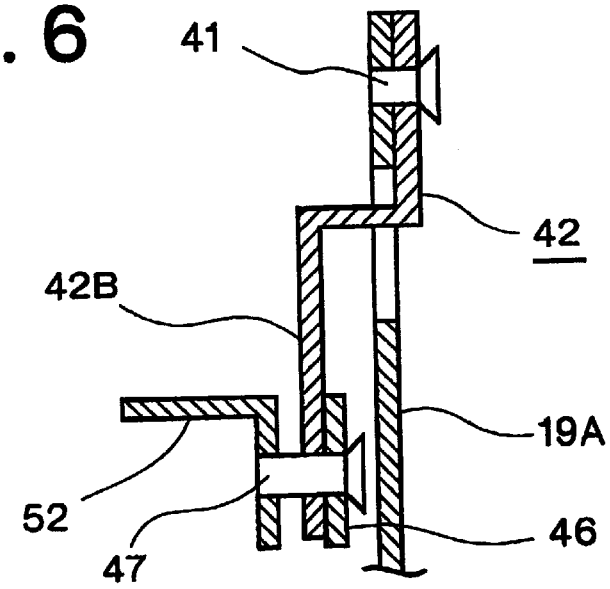
FIG. 6 is a cross sectional view of line X—X in FIG. 4.

As shown in FIGS. 4 and 5, a child-proof mechanism 45 is provided between the inner lever 42 and the open lever 20. The child-proof mechanism 45 includes a longitudinal child-link 46 which has an upper end connected to a second arm 42B of the inner lever 42 by a pin 47. The child-link 46 is formed at the lower part thereof with a longitudinal slot 48 with which a pin 50 of a child-proof operating lever 49 is slidably engaged. The child-link 46 is swung around the pin 47 in response to the actuation of the operating lever 49 to be displaced between a child-proof position and a non-child-proof position.

An engaging piece 51 is provided at the lower part of the child-link 46. As shown in FIG. 5, the engaging piece 51 is engageably opposed to the interior side end 20A of the open lever 20 when the child-link 46 is being in, the non-child-proof position. In this non-child-proof state, when rotating the inner lever 42 by the inside open handle 43, the child-link 46 is moved upward, and the engaging piece 51 is then brought into contact with the open lever 20 to rotate the open lever 20. Thereby, the door is opened if the lock lever 21 is being in the unlocked position U.

The engaging piece 51 cannot be engaged with the interior side end 20A of the open lever 20 when the child-link 46 is displaced to the child-proof position. In this child-proof state, even when moving the child-link 46 upward by the opening actuation of the inside open handle 43, the engaging piece 51 is not brought into contact with the open lever 20, and therefore, the door is not opened.

The child-proof mechanism 45 includes a longitudinal release link 52 which has an upper end connected to the second arm 42B of the inner lever 42 by the pin 47. The release link 52 has at the lower part thereof a pin 53 which is slidably engaged with a circular arc slot 54 formed in an interior side end 33A of the safety lever 33. The release link 52 transmits the opening actuation of the inside open handle 43 to the safety lever 33 without rotating the open lever 20, even if the child-proof mechanism 45 is in the child-proof state. Therefore, it is possible to actuate the safety mechanism 39 of the powered closing mechanism 37 by the opening actuation of the inside open handle 43, without damaging the original function of the child-proof mechanism 45 of preventing the door from being unexpectedly opened by an accidental operation of a child.

Figure 8:
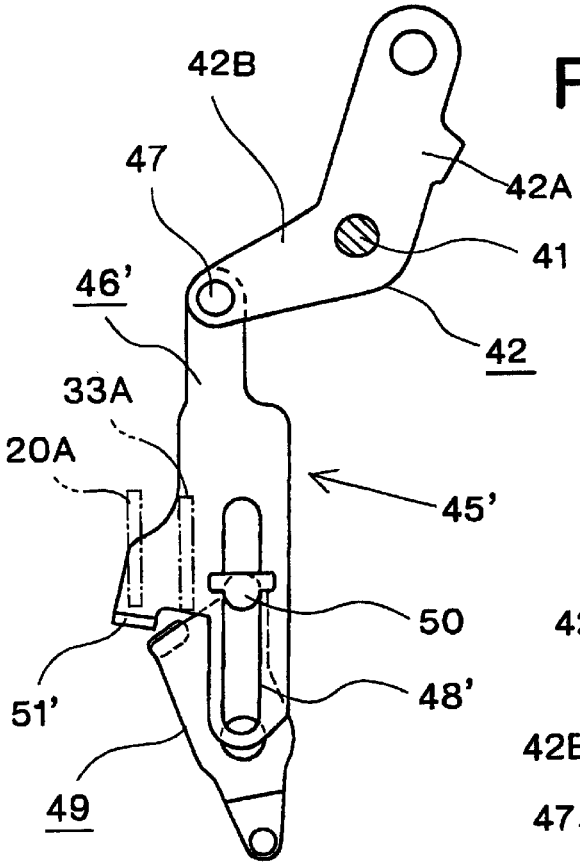
FIG. 8 is a side view showing the child-proof mechanism of the second embodiment in the non-child-proof state.
Figure 7:
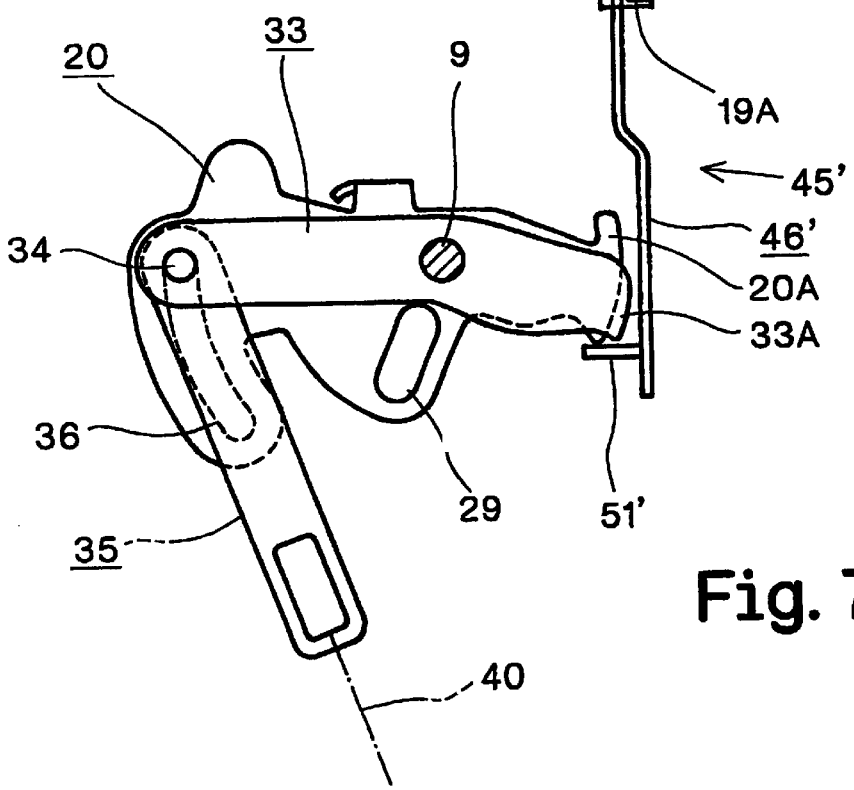
FIG. 7 is a rear view showing a child-proof mechanism of a second embodiment according to the present invention.

In FIGS. 7–9, a child-proof mechanism 45' of another embodiment of the present invention is illustrated., The child-proof mechanism 45' includes a longitudinal child-link 46' which has an upper end connected to the second arm 42B of the inner lever 42 by the pin 47. The child-link 46' is formed at the lower part thereof with a longitudinal slot 48' with which the pin 50 of the child-proof operating lever 49 is slidably engaged. The child-link 46' is swung around the pin 47 in response to the actuation of the operating lever 49 to be displaced between the child-proof position and the non-child-proof position.

An engaging piece 51' is provided at the lower part of the child-link 46'. As shown in FIG. 8, the engaging piece 51' is engageably opposed to the interior side end 20A of the open lever 20 when the child-link 46' is being in the non-child-proof position. In this non-child-proof state, when rotating the inner lever 42 by the inside open handle 43, the child-link 46' is moved upward, and the engaging piece 51' is then brought into contact with the open lever 20 to rotate the open lever 20. Thereby, the door is opened if the lock lever 21 exists in the unlocked position U.

When the child-link 46' is displaced to the child-proof position as shown in FIG. 9, the engaging piece 51' is separated from the interior side end 20A of the open lever 20, and instead of that, it is engageably opposed to the interior side end 33A of the safety lever 33. In this child-proof state, when the child-link 46' is moved upward by the opening actuation of the inside open handle 43, the engaging piece 51' is not brought into contact with the open lever 20, and therefore, the door is not opened, but the safety lever 33 can be rotated. Therefore, it is possible to actuate the safety mechanism 39 of the powered closing mechanism 37 by the opening actuation of the inside open handle 43, without damaging the original function of the child-proof mechanism 45' of preventing the door from being unexpectedly opened by an accidental operation of a child.

In FIG. 10, a child-proof mechanism 45" of still another embodiment is shown. A child-link 46" of the child-proof mechanism 45" has engaging pieces 51"A and 51"B as a pair. When the child-link 46" exists in the non-child-proof position, the engaging piece 51"A is engageably opposed to the interior side end 20A of the open lever 20, but the engaging piece 51"B cannot be engaged with any member. Further, when the child-link 46" exists in the child-proof position, the engaging piece 51"A cannot be engaged with any member, but the engaging piece 51"B is engageably opposed to the interior side end 33A of the safety lever 33. Consequently, it is possible to actuate the safety mechanism 39 of the powered closing mechanism 37 by the opening actuation of the inside open handle 43, without damaging the original function of the child-proof mechanism 45" of preventing the door from being unexpectedly opened by an accidental operation of a child.

What is claimed is:

1. A vehicle door latch device comprising:

a latch engageable with a striker fixed to a vehicle body;

a ratchet engageable with the latch to keep engagement between the latch and the striker;

an open lever for connection to an outside open handle of a door and arranged to release the ratchet from the latch when rotated;

an inner lever for connection to an inside open handle of the door;

a child-proof mechanism provided between the inner lever and the open lever, said child-proof mechanism being displaceable between a non-child-proof state where rotation of the inner lever is transmitted to the open lever and a child-proof state where the rotation of the inner lever is not transmitted to the open lever;

a powered closing mechanism arranged to rotate the latch toward a full-latched position from a half-latched position by motor power thereof; and a safety mechanism arranged to urgently stop actuation of the powered closing mechanism in response to rotation of the open lever;

wherein said child-proof mechanism has a transmitting means which transmits the rotation of the inner lever to the safety mechanism to actuate the safety mechanism in the child-proof state, without rotating the open lever.

2. The vehicle door latch device according to claim 1, wherein said safety mechanism comprises a safety lever connected to the open lever through a first lost-motion which transmits the rotation of the open lever to the safety lever, but which does not transmit rotation of the safety lever to the open lever.

3. The vehicle door latch device according to claim 2, wherein said transmitting means comprises a release link which connects the safety lever and the inner lever.

4. The vehicle door latch device according to claim 2, wherein said transmitting means comprises a child-link having one end connected to the inner lever, and wherein the other end of the child-link is engageably opposed to the open lever in the non-child-proof state, and is engageably opposed to the safety lever in the child-proof state.

5. The vehicle door latch device according to claim 2, wherein said safety lever and said open lever are supported by a common shaft.

* * * * *